US008181832B2

(12) United States Patent
Ho et al.

(10) Patent No.: US 8,181,832 B2
(45) Date of Patent: May 22, 2012

(54) GARMENT HANGER INCLUDING SLIDE-IN SIZER

(75) Inventors: Leung Ho, Kowloon (HK); Kevin R. Sullivan, Annandale, NJ (US)

(73) Assignee: The Build-Up Plastic & Metal Co., Ltd., Kowloon (HK)

( * ) Notice: Subject to any disclaimer, the term of this patent is extended or adjusted under 35 U.S.C. 154(b) by 153 days.

(21) Appl. No.: 12/474,502

(22) Filed: May 29, 2009

(65) Prior Publication Data

US 2009/0294493 A1 Dec. 3, 2009

Related U.S. Application Data

(60) Provisional application No. 61/118,801, filed on Dec. 1, 2008, provisional application No. 61/057,084, filed on May 29, 2008.

(51) Int. Cl.
*A41D 27/22* (2006.01)

(52) U.S. Cl. ..... 223/85; 40/322

(58) Field of Classification Search ..... 223/85, 223/88, 92, 95; 40/322
See application file for complete search history.

(56) References Cited

U.S. PATENT DOCUMENTS

| | | | |
|---|---|---|---|
| 1,142,720 | A | 6/1915 | McAuley |
| 1,321,926 | A | 11/1919 | Landry |
| 1,348,952 | A | 8/1920 | Landry |
| 1,389,266 | A | 8/1921 | Newton |
| 1,710,296 | A | 4/1929 | Clark |
| 2,166,492 | A | 7/1939 | Harvey |
| 2,690,863 | A | 10/1954 | Adelman |
| 2,801,036 | A | 7/1957 | Klein |
| 3,024,953 | A | 3/1962 | O'Keefe |
| D192,845 | S | 5/1962 | Cohen |
| 3,535,808 | A | 10/1970 | Morrish |
| D229,810 | S | 1/1974 | Wahl |
| D235,639 | S | 7/1975 | Cohen |
| 3,898,754 | A | 8/1975 | Johansson |
| 3,949,914 | A | 4/1976 | Ostroll |
| 4,006,547 | A | 2/1977 | Samuels et al. |
| 4,017,990 | A | 4/1977 | Garrison |
| D244,197 | S | 5/1977 | Ostroll |
| 4,045,899 | A | 9/1977 | Richardson |
| 4,115,940 | A | 9/1978 | Phillips |
| 4,123,864 | A | 11/1978 | Batts et al. |
| 4,137,661 | A | 2/1979 | Johansson |

(Continued)

FOREIGN PATENT DOCUMENTS

AU B1-42320/78 6/1979

(Continued)

OTHER PUBLICATIONS

U.S. Appl. No. 10/889,433, by Ho, et al., filed Jul. 12, 2004.

(Continued)

*Primary Examiner* — Nathan Durham
(74) *Attorney, Agent, or Firm* — Schroeder Law PC

(57) ABSTRACT

A garment hanger having a slide-in sizer. The hanger includes a sizer-receiving frame defining at least one sizer-receiving slot for sliding receipt of a substantially flat and planar sizer. In one preferred embodiment, the sizer is formed from paper. The sizer-receiving frame may be positioned within a notch defined between the junction of the body and the base portion of the hook. Alternatively, the sizer-receiving frame may be positioned at the upper portion of the hook.

5 Claims, 6 Drawing Sheets

U.S. PATENT DOCUMENTS

| | | | | |
|---|---|---|---|---|
| 4,160,333 | A | | 7/1979 | Indelicato |
| 4,198,773 | A | | 4/1980 | Batts et al. |
| 4,322,902 | A | | 4/1982 | Lenthall |
| 4,450,639 | A | | 5/1984 | Duester |
| 4,653,678 | A | | 3/1987 | Blanchard et al. |
| 4,679,340 | A | | 7/1987 | Johansson |
| 4,756,104 | A | | 7/1988 | Bailey |
| 4,863,078 | A | * | 9/1989 | Bengsch ..... 223/85 |
| 4,881,836 | A | | 11/1989 | Blanchard |
| 4,886,195 | A | | 12/1989 | Blanchard |
| 4,967,500 | A | | 11/1990 | Bredeweg |
| 4,997,114 | A | | 3/1991 | Petrou |
| 5,056,248 | A | | 10/1991 | Blanchard |
| 5,096,101 | A | | 3/1992 | Norman et al. |
| 5,135,141 | A | | 8/1992 | Harmer et al. |
| 5,199,608 | A | | 4/1993 | Zuckerman |
| 5,238,159 | A | | 8/1993 | Zuckerman |
| 5,305,933 | A | | 4/1994 | Zuckerman |
| 5,377,884 | A | | 1/1995 | Zuckerman |
| 5,381,938 | A | | 1/1995 | Vasudeva |
| 5,383,583 | A | | 1/1995 | Zuckerman |
| 5,388,354 | A | | 2/1995 | Marshall et al. |
| 5,407,109 | A | | 4/1995 | Zuckerman |
| 5,441,182 | A | | 8/1995 | Sullivan |
| 5,449,099 | A | | 9/1995 | Blanchard |
| 5,469,995 | A | | 11/1995 | Bredeweg et al. |
| 5,477,995 | A | | 12/1995 | Dooley et al. |
| 5,485,943 | A | | 1/1996 | Zuckerman |
| 5,503,310 | A | | 4/1996 | Zuckerman et al. |
| 5,524,801 | A | | 6/1996 | Dooley et al. |
| 5,573,151 | A | | 11/1996 | Fildan |
| 5,586,697 | A | | 12/1996 | Johansson |
| 5,590,822 | A | | 1/1997 | Zuckerman |
| 5,597,100 | A | | 1/1997 | Blitz |
| 5,603,437 | A | | 2/1997 | Zuckerman |
| 5,611,469 | A | | 3/1997 | Eiley et al. |
| 5,613,629 | A | | 3/1997 | Zuckerman |
| 5,628,132 | A | | 5/1997 | Marshall et al. |
| 5,641,100 | A | | 6/1997 | Mitchell et al. |
| 5,642,840 | A | | 7/1997 | Abdi |
| 5,683,018 | A | | 11/1997 | Sullivan et al. |
| 5,687,887 | A | | 11/1997 | Bond et al. |
| 5,775,553 | A | | 7/1998 | Marshall et al. |
| 5,778,575 | A | | 7/1998 | Deupree et al. |
| 5,785,216 | A | | 7/1998 | Gouldson et al. |
| 5,794,363 | A | | 8/1998 | Marshall et al. |
| 5,819,995 | A | | 10/1998 | Zuckerman |
| 5,857,276 | A | | 1/1999 | Marshall et al. |
| 5,884,422 | A | | 3/1999 | Marshall et al. |
| D410,793 | S | | 6/1999 | Gouldson |
| 5,913,462 | A | | 6/1999 | Petrou |
| 5,944,237 | A | | 8/1999 | Gouldson |
| D414,044 | S | | 9/1999 | Choi et al. |
| 5,950,883 | A | | 9/1999 | Bond et al. |
| 6,019,260 | A | | 2/2000 | Gouldson |
| 6,029,868 | A | | 2/2000 | Willinger et al. |
| 6,041,983 | A | | 3/2000 | Sullivan et al. |
| 6,041,984 | A | | 3/2000 | Gouldson |
| 6,145,713 | A | | 11/2000 | Zuckerman |
| 6,189,746 | B1 | | 2/2001 | Gouldson |
| D440,409 | S | | 4/2001 | Blanchard |
| 6,209,241 | B1 | | 4/2001 | Louw |
| 6,260,745 | B1 | | 7/2001 | Gouldson et al. |
| 6,264,075 | B1 | | 7/2001 | Gouldson et al. |
| 6,378,744 | B2 | | 4/2002 | Olk et al. |
| 6,382,478 | B2 | | 5/2002 | Gouldson et al. |
| 6,409,057 | B1 | | 6/2002 | Kim |
| 6,422,437 | B2 | | 7/2002 | Gouldson et al. |
| 6,499,633 | B1 | | 12/2002 | Pogmore |
| 6,499,634 | B2 | | 12/2002 | Olk et al. |
| 6,523,240 | B1 | | 2/2003 | Gouldson |
| 6,564,980 | B2 | | 5/2003 | Gouldson et al. |
| 6,609,640 | B1 | | 8/2003 | Bokmiller |
| 6,622,897 | B2 | | 9/2003 | Bokmiller et al. |
| 6,726,067 | B2 | | 4/2004 | Louw |
| 7,015,815 | B1 | | 3/2006 | Feibelman |
| 2001/0011663 | A1 | | 8/2001 | Olk et al. |
| 2001/0016994 | A1 | | 8/2001 | Gouldson et al. |
| 2001/0019070 | A1 | | 9/2001 | Gouldson et al. |
| 2002/0184799 | A1 | | 12/2002 | Chou |
| 2003/0019137 | A1 | | 1/2003 | Giustini et al. |
| 2003/0173381 | A1 | | 9/2003 | Louw |
| 2003/0178451 | A1 | | 9/2003 | Giustini et al. |
| 2004/0211796 | A1 | | 10/2004 | Misumi |
| 2006/0011673 | A1 | | 1/2006 | Gouldson |
| 2006/0049222 | A1 | | 3/2006 | Pluchino et al. |
| 2007/0175932 | A1 | | 8/2007 | Wu |
| 2007/0228089 | A1 | | 10/2007 | Mainetti |
| 2008/0035685 | A1 | | 2/2008 | Matkovich et al. |

FOREIGN PATENT DOCUMENTS

| | | | |
|---|---|---|---|
| AU | B1-55 988/80 | | 6/1980 |
| AU | A-49049/85 | | 5/1986 |
| DE | 3306781 | A1 | 8/1984 |
| DE | 3401816 | A1 | 7/1985 |
| GB | 2064472 | A | 6/1981 |
| GB | 2140679 | A | 1/1984 |
| GB | 2386320 | A | 9/2003 |
| JP | Y-S48-23356 | | 7/1973 |
| JP | U-S52-009400 | | 1/1977 |
| JP | U-S52-043890 | | 3/1977 |
| JP | U-S57-095869 | | 6/1982 |
| JP | U-S57-189540 | | 12/1982 |
| JP | U-S61-11374 | | 1/1986 |
| JP | U-S61-147062 | | 9/1986 |
| JP | U-H03-019354 | | 2/1991 |
| JP | U-H05-037183 | | 5/1993 |
| JP | U-H06-052800 | | 7/1994 |
| JP | U-H07-025872 | | 5/1995 |
| JP | A-H07-241229 | | 9/1995 |
| JP | A-H08-140816 | | 6/1996 |
| JP | U-H08-001346 | | 9/1996 |
| JP | A-H10-052356 | | 2/1998 |
| JP | A-2000-287817 | | 10/2000 |
| JP | A-2001-062190 | | 3/2001 |
| JP | A-2001-112605 | | 4/2001 |
| WO | WO96/23436 | | 8/1996 |
| WO | WO 01/50930 | A1 | 7/2001 |

OTHER PUBLICATIONS

U.S. Appl. No. 11/803,106, by Leung Ho, filed May 11, 2007.

U.S. Appl. No. 12/474,725 by Leung Ho, filed May 29, 2009.

Reference Hanger 1—Photographs of commercially-available garment hanger with size indicator; Jul. 1, 2003.

Reference Hanger 2—Photographs of commercially-available garment hanger with size indicator; Jul. 1, 2003.

Reference Hanger 3—Photographs of commercially-available garment hanger with size indicator; Jul. 1, 2003.

Reference Hanger 4—Photographs of commercially-available garment hanger with size indicator; Jul. 1, 2003.

Reference Hanger 5—Photographs of commercially-available garment hanger with size indicator; Jul. 1, 2003.

Reference Hanger 6—Photographs of commercially-available garment hanger with size indicator; Jul. 1, 2003.

Reference Hanger 7—Photographs of commercially-available garment hanger with size indicator; Jul. 1, 2003.

Reference Hanger 8—Photographs of commercially-available garment hanger with size indicator; Jul. 1, 2003.

Reference Hanger 9—Photographs of commercially-available garment hanger with size indicator; Jul. 1, 2003.

Reference Hanger 10—Photographs of commercially-available garment hanger with size indicator; Jul. 1, 2003.

Reference Hanger 11—Photographs of commercially-available garment hanger with size indicator; Jul. 1, 2003.

Reference Hanger 12—Photograph of commercially-available garment hanger with size indicator; Jul. 1, 2003.

* cited by examiner

GARMENT HANGER INCLUDING SLIDE-IN SIZER

This application claims the benefit of U.S. Provisional Application Ser. No. 61/118,801 filed Dec. 1, 2008 and U.S. Provisional Application Ser. No. 61/057,084 filed May 29, 2008, the disclosures of which are hereby incorporated by reference in their entirety.

BACKGROUND OF THE INVENTION

The present invention relates to garment hangers and, more particularly, to garment hangers having sizers coupled thereto. Garment hangers are often provided with size indicators, also known as sizers, for providing indicia relating to the size or type of garment hung on the hanger, or other information. Such indicators are often in the form of small U-shaped tabs that are clipped on the hanger body. A common location for securing a size indicator to a hanger is a web portion of the hanger formed between the bottom end of the hanger hook and the top of the hanger body. Typical prior art arrangements are disclosed in U.S. Pat. Nos. 4,115,940, 5,096,101, 5,199,608, 5,238,159, 5,305,933, 5,383,583, 5,407,109, 5,441,182 and 5,449,099.

As will be recognized by those skilled in the art, the mentioned U-shaped size indicators are typically formed of plastic, and are designed to be secured to a hanger in a substantially non-removable manner, thereby reducing the likelihood that such indicators may be inadvertently removed from the hanger. The desire to couple the size indicator to the hanger in a non-removable manner typically increases the cost and complexity of such prior art indicators. Moreover, these prior art indicators are often times clipped to the hanger in a manner which allows the indicator to "wobble," which can detract from the overall aesthetic appeal of the hanger. It will be further appreciated that the very same design which increases the difficulty of removing the indicator from the hanger also increases the installation force required to install the indicator on the hanger body thereby rendering assembly more difficult and costly. Finally, it will be appreciated that any reduction in the usage of plastic is viewed as having a positive impact on the environment.

There is therefore a need in the art for a hanger/sizer combination which provides a less complex and costly design, which allows for ready assembly of the components, which reduces the environmental impact through decreased usage of plastic, which is more child friendly, and which provides increased flexibility for printing of indicia/graphics on the sizer.

SUMMARY OF THE INVENTION

The present invention, which addresses the needs of the prior art, relates to a garment hanger having a slide-in side sizer. In particular, the garment hanger includes a body. The garment hanger further includes a hook having a base portion joined to the body and an outer surface forming an acute angle with the body. The acute angle defines a notch at the junction of the body and the base portion of the hook. The garment hanger further includes a sizer-receiving frame positioned within the notch. At least a portion of the frame extends between and connects the hanger body and the base portion of the hook. The frame defines a sizer-receiving slot. The hanger body and the hook and the frame are generally coplanar. Finally, the garment hanger includes a substantially flat and planar sizer positioned within the slot of the frame.

The present invention further relates to a garment hanger having a slide-in top sizer. In particular, the garment hanger includes a body and a hook extending from the body. The garment hanger further includes a sizer-receiving frame secured to an upper portion of the hook. The frame defines a sizer-receiving slot. Finally, the garment hanger includes a substantially flat and planar sizer positioned within the slot of the frame.

As a result, the present invention provides a hanger-sizer combination which is less complex and less costly in design, which allows for ready assembly of the components, which reduces the environmental impact through decreased usage of plastic, which is more child friendly, and which provides increased flexibility for printing of indicia/graphics on the sizer.

DETAILED DESCRIPTION OF THE INVENTION

Figure 1:
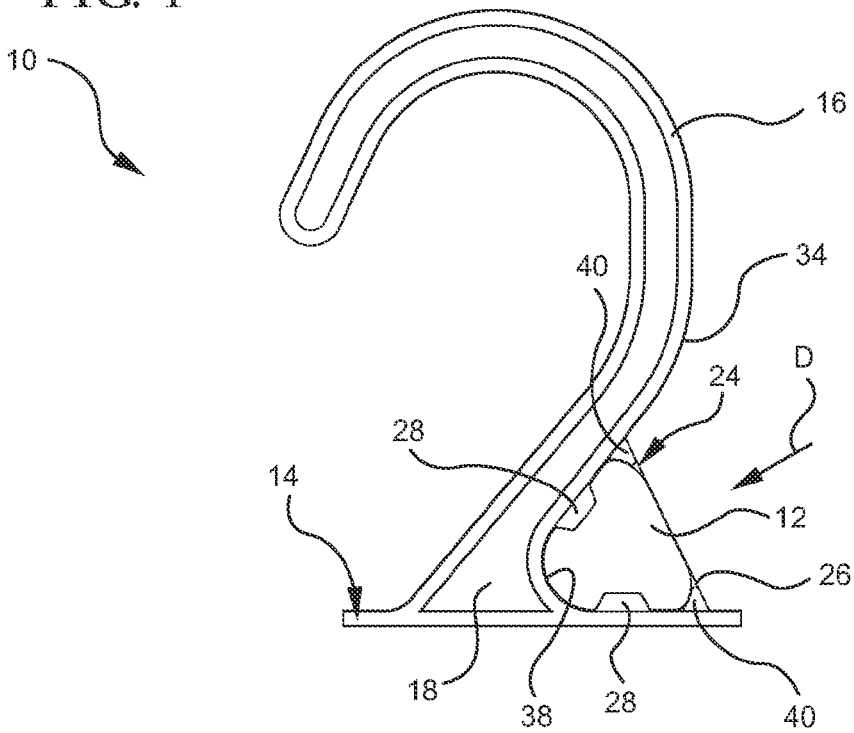
FIG. 1 is an elevation view showing the hanger/sizer combination of the present invention.
Figure 2:
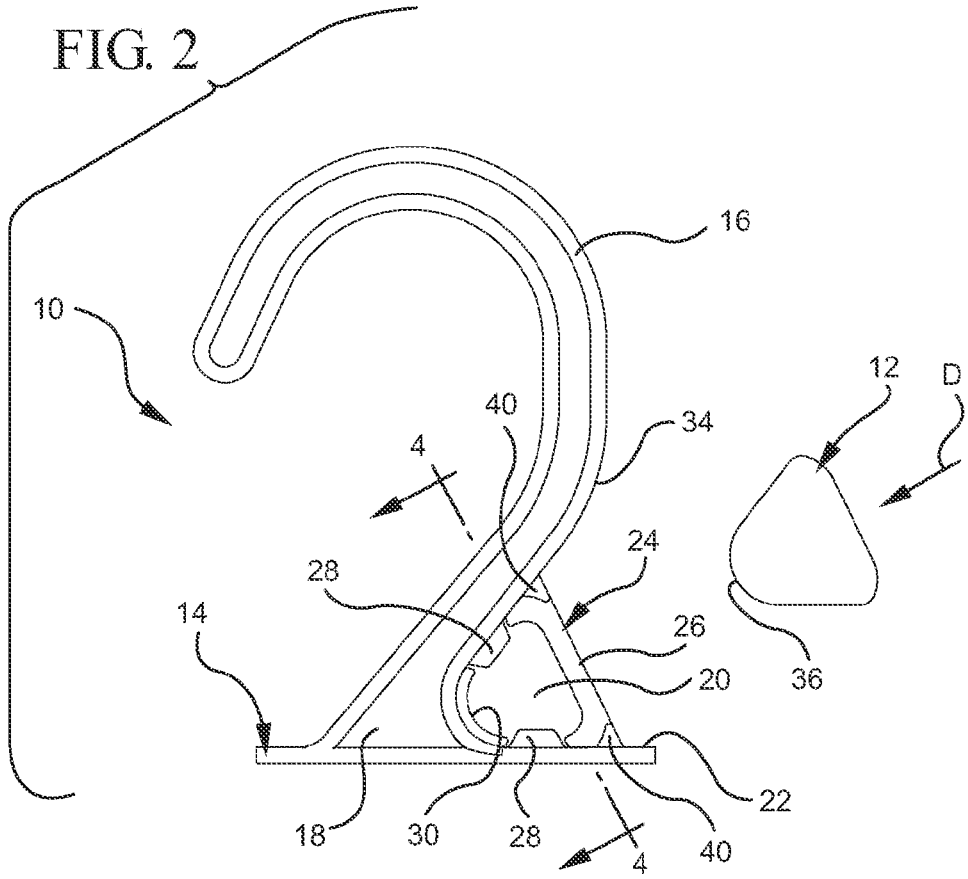
FIG. 2 is a view similar to FIG. 1 showing the sizer removed from the hanger.
Figure 3:
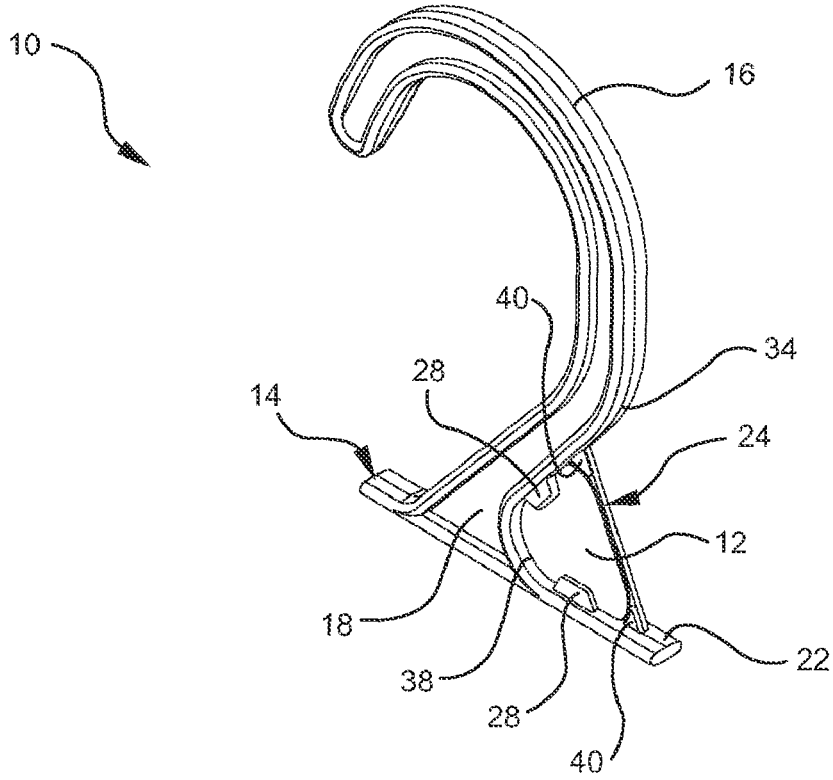
FIG. 3 is a perspective view of the hanger/sizer combination of FIG. 1.

A garment hanger 10 is provided with a side sizer 12 in a manner that allows a person to easily view the information, such as garment size, provided on the sizer. As shown in FIGS. 1-3, garment hanger 10 includes a body 14. It is contemplated herein that body 14 can be formed with a pair of downwardly-depending arms as shown in U.S. Pat. No. 5,096,101 or, alternatively, can include a horizontally-extending bar as shown in U.S. Pat. Nos. 5,199,608 and 5,383,583.

A hook 16 is joined to body 14, preferably at the central portion of the hanger. The hook includes a base portion 18 that includes an outer surface extending at an acute angle with respect to an outer surface of body 14. A notch 20 is accordingly formed between base portion 18 of hook 16 and a top surface 22 of body 14.

Figure 4:
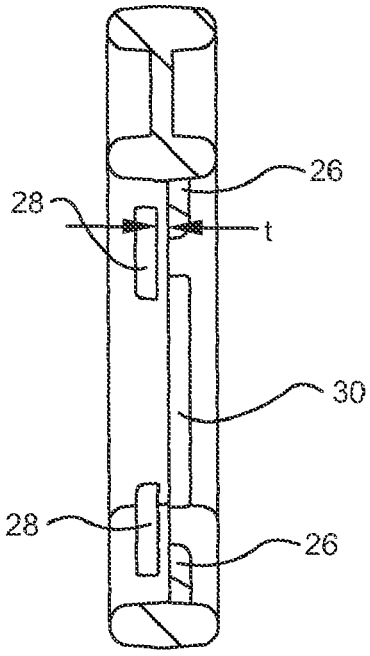
FIG. 4 is a view taken along lines 4-4 of FIG. 2.
Figure 5:
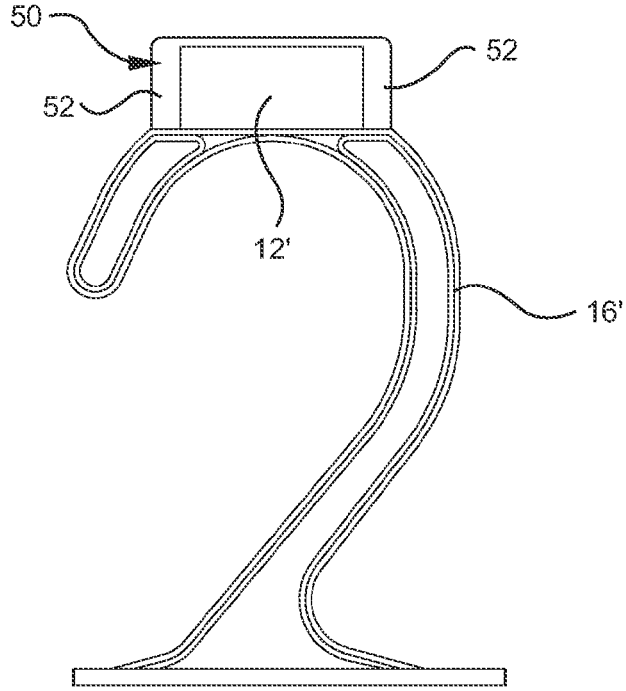
FIG. 5 is an elevation view of a second embodiment of a hanger/sizer combination formed in accordance with the present invention.
Figure 6:
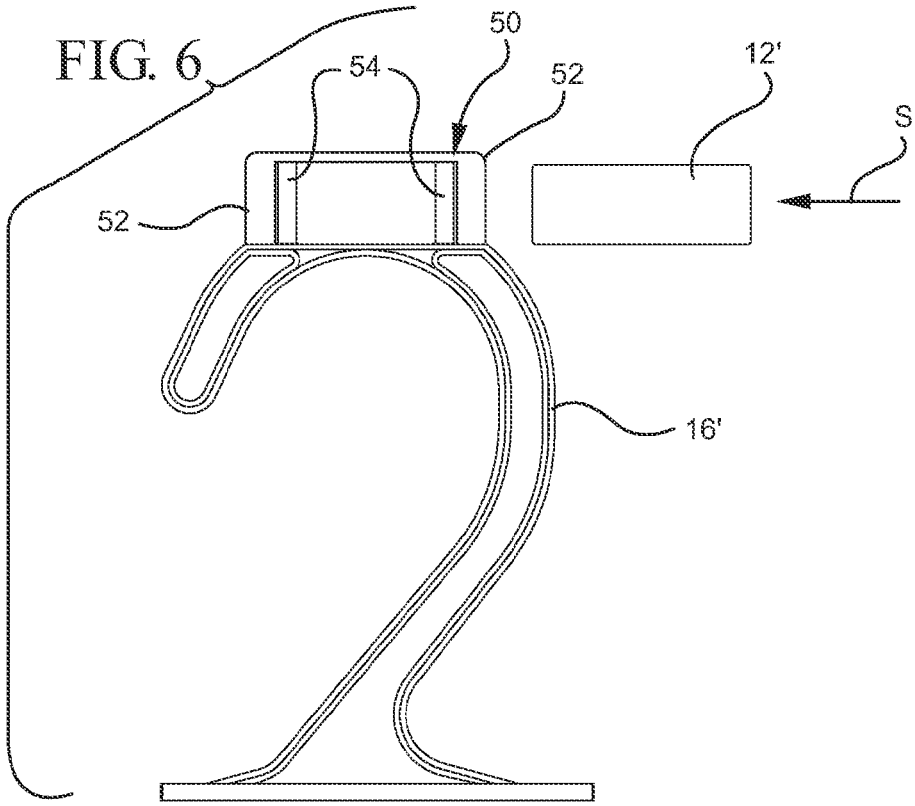
FIG. 6 is a view similar to FIG. 5 showing the sizer removed from the hanger.
Figure 7:
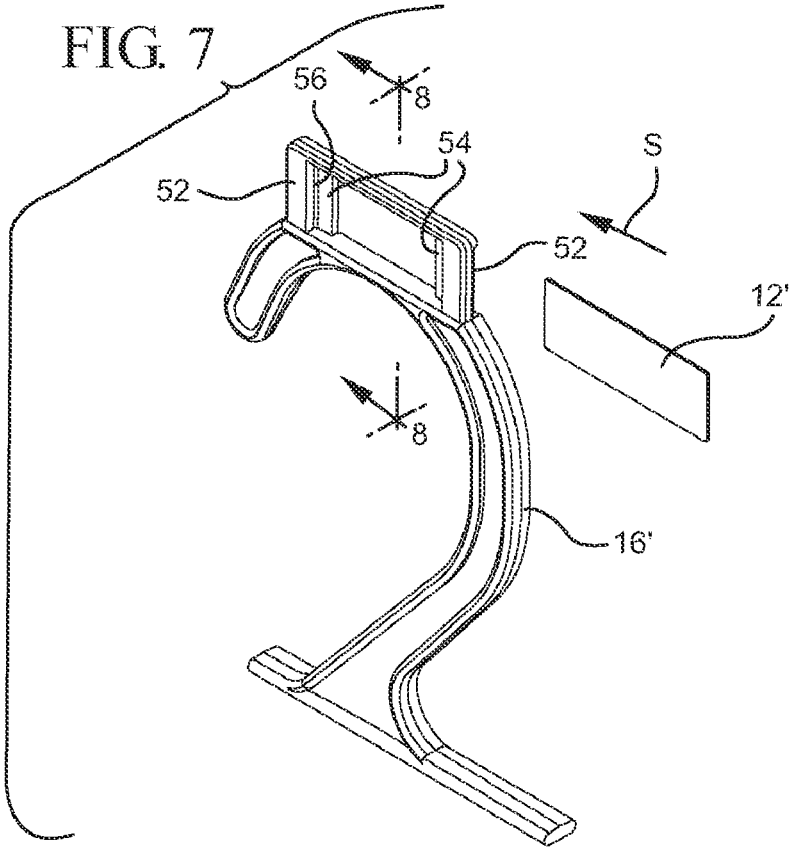
FIG. 7 is a perspective view of the second embodiment showing the sizer removed from the hanger.
Figure 8:
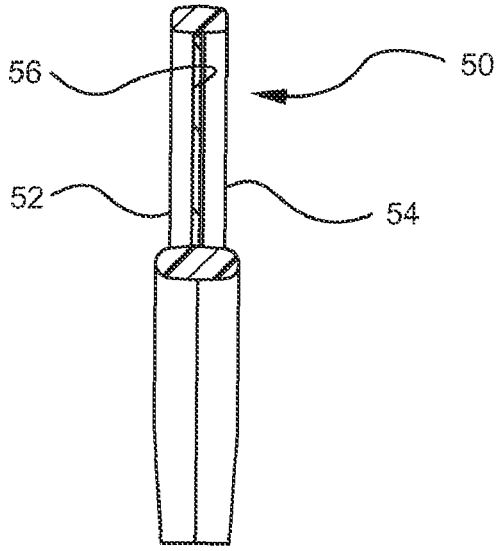
FIG. 8 is a view taken along lines 8-8 of FIG. 7.

A sizer-receiving frame 24 is positioned within notch 20. The frame is integral with both body 14 and base portion 18 of hook 16. Frame 24 includes a sizer-supporting arm 26, a pair of sizer-supporting tabs 28, and a sizer-supporting edge 30 located at the apex of notch 20. As best seen in FIG. 4, arm 26 and tabs 28 together define a sizer-receiving slot 32 having a thickness t approximately equal to the thickness of sizer 12.

Thus, garment hanger 10 (except for sizer 12) is preferably an integrally molded plastic structure. It includes a substantially continuous peripheral wall 34 that provides stiffness. The wall may include gaps (not shown) in certain portions of the hanger that may be used to support garments or may be provided with clips or the like (not shown).

Sizer 12 is preferably an integrally formed component. In one preferred embodiment, sizer 12 is formed of paper, thus reducing the overall usage of resin in the hanger/sizer combination. As will be appreciated by those skilled in the art, this reduction in usage of resin is believed to be positive for the environment. Moreover, the usage of paper for the sizer provides a more child-friendly product, as well as an improved base for printing and/or application of graphics thereon. Although paper is the preferred material for sizer 12, it is nonetheless completed herein that sizer 12 could be formed of plastic or other suitable material.

As shown, sizer 12 is a substantially flat planar member, and is shaped and sized to substantially match the configuration of notch 20. More particularly, sizer 12 is shaped and sized to rest against the top surface of arm 26 (as viewed in FIG. 2), to rest against the bottom surfaces of tabs 28 (as viewed in FIG. 2), and to rest against the top surface of edge 30 (as viewed in FIG. 2). To assemble the hanger/sizer combination, sizer 12 is inserted into slot 32 of frame 24 in the direction of arrows D. In one preferred embodiment, sizer 12 is inserted until nose portion 36 contacts surface 38 of notch 20. It will be appreciated that installation of the present sizer requires significantly less installation force than prior art U-shaped plastic sizers, thereby making the assembly process easier and less costly. It also allows the sizer to be more easily removed from the hanger, if desired (e.g., during recycling).

In another preferred embodiment, arm 26 is provided with a pair of locking corners 40 on the top surface thereof (as viewed in FIG. 2). The corners are preferably sized and shaped so as to allow sizer 12 to be readily inserted therepast, but which resist movement of the sizer in a withdrawal direction. Thus, corners 40 act to secure the sizer within the frame once such sizer is fully inserted. In another preferred embodiment, an adhesive can be located on one or both of the sizer and arm 26 to assist in securing the sizer within frame 24.

Although the embodiment shown in FIGS. 1-4 is directed to what is commonly referred to as a side sizer, it is contemplated herein that the slide-in sizer of the present invention can also be used in a top sizer arrangement. More particularly, as shown in FIGS. 5-8, a sizer-receiving frame 50 can be secured to an upper portion of hook 16' and can be sized and shaped to receive an alternative sizer, e.g., top sizer 12'. In this regard, frame 50 preferably includes opposing edges 52, and a pair of sizer-supporting walls 54. A sizer-receiving slot 56 is defined between edges 52 and walls 54, and is sized to receive sizer 12'. In particular, sizer 12' is inserted into slot 56 of frame 50 in the direction of arrows S until the sizer is fully received therein. Once inserted, the sizer preferably rests against the surfaces defined by edges 52 and walls 54.

Figure 9:
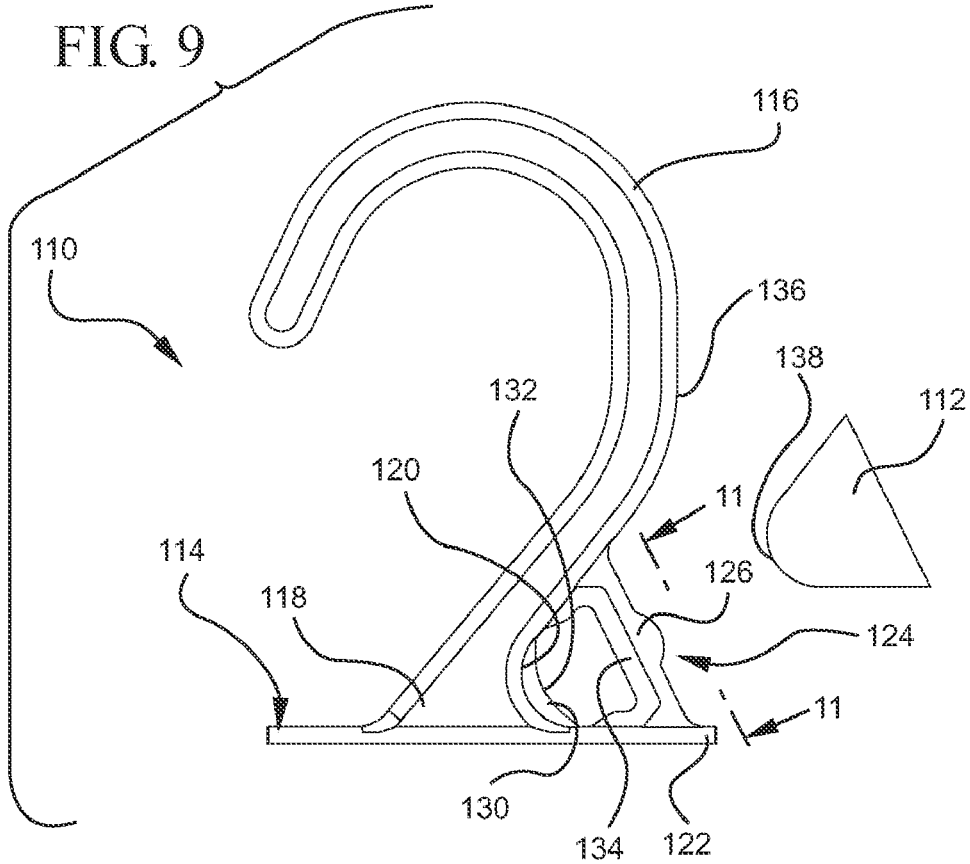
FIG. 9 is an exploded front perspective view of a third embodiment of a hanger and sizer formed in accordance with the present invention.
Figure 10:
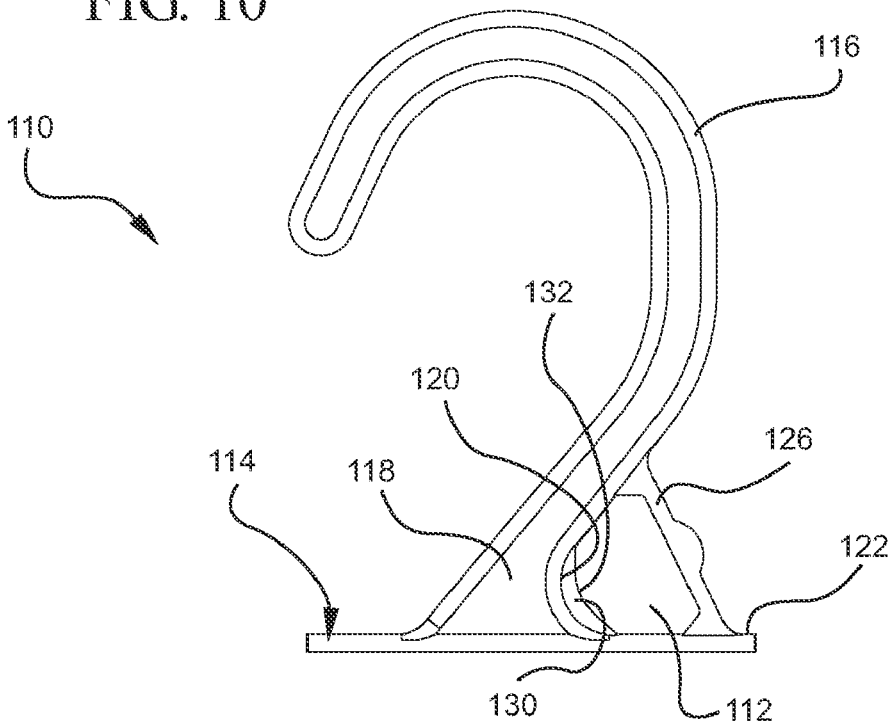
FIG. 10 is a view similar to FIG. 9 showing the hanger/sizer combination.
Figure 11:
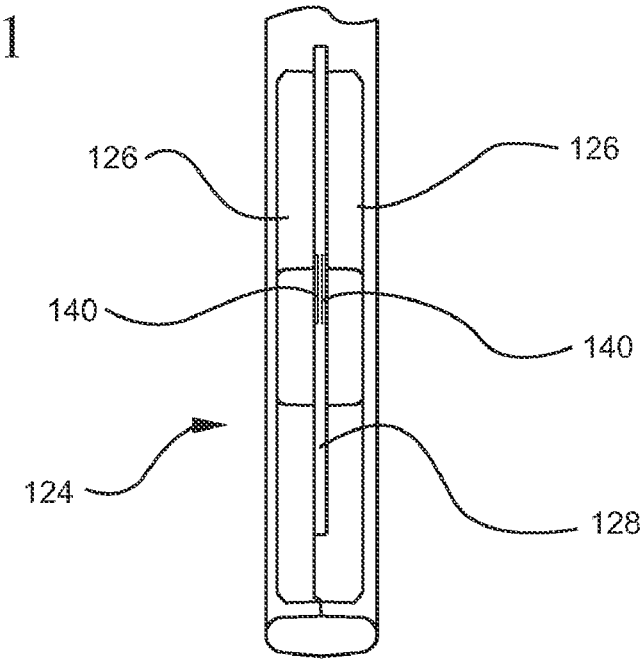
FIG. 11 is a view taken along lines 11-11 of FIG. 9.

In another embodiment of the present invention, a garment hanger 110 is provided with a side sizer 112 in a manner that allows a person to easily view the information, such as garment size, provided on the sizer. As shown in FIGS. 9-11, garment hanger 110 includes a body 114. It is contemplated herein that body 114 can be formed with a pair of downwardly-depending arms as shown in U.S. Pat. No. 5,096,101 or, alternatively, can include a horizontally-extending bar as shown in U.S. Pat. Nos. 5,199,608 and 5,383,583.

A hook 116 is joined to body 114, preferably at the central portion of the hanger. The hook includes a base portion 118 that includes an outer surface extending at an acute angle with respect to an outer surface of body 114. A notch 120 is accordingly formed between base portion 118 of hook 116 and a top surface 122 of body 114.

A sizer-receiving frame 124 is positioned within the notch. The frame is integral with both body 114 and base portion 118 of hook 116. Frame 124 includes opposing walls 126 defining a slot 128 therebetween, as well as opposing walls 130 defining a second slot 132 therebetween. Frame 124 may further include a pair of opposing sizer-supporting edges 134 extending at least partially between walls 126 and walls 130.

Thus, garment hanger 110 (except for sizer 112) is preferably an integrally molded plastic structure. It includes a substantially continuous peripheral wall 136 that provides stiffness. The wall may include gaps (not shown) in certain portions of the hanger that may be used to support garments or may be provided with clips or the like (not shown).

Sizer 112 is preferably an integrally formed component. In one preferred embodiment, sizer 112 is formed of paper, thus reducing the overall usage of resin in the hanger/sizer combination. As will be appreciated by those skilled in the art, this reduction in usage of resin is believed to be positive for the environment. Moreover, the usage of paper for the sizer provides a more child-friendly product, as well as an improved base for printing and/or application of graphics thereon. Although paper is the preferred material for sizer 112, it is nonetheless completed herein that sizer 112 could be formed of plastic or other suitable material.

As best seen in FIG. 10, sizer 112 is shaped and sized to substantially match the configuration of notch 120. To assemble the hanger/sizer combination, sizer 112 is inserted through slot 128 and into notch 120 until apex 138 of sizer 112 is received within slot 132 defined by opposing walls 130. In this position, sizer 112 is supported by opposing walls 126, opposing walls 130 and by edges 134.

In one preferred embodiment, opposing walls 126 are provided with a pair of ramping surfaces 140 which allows sizer 112 to be readily inserted therepast, but which resist movement of the sizer in a withdrawal direction. In another preferred embodiment, an adhesive can be located on one or both of the sizer and frame to assist in securing the sizer to the frame. In still another preferred embodiment, the sizer-receiving frame can include opposing edges 134 to provide additional support to the sizer around the periphery thereof.

Figure 12:
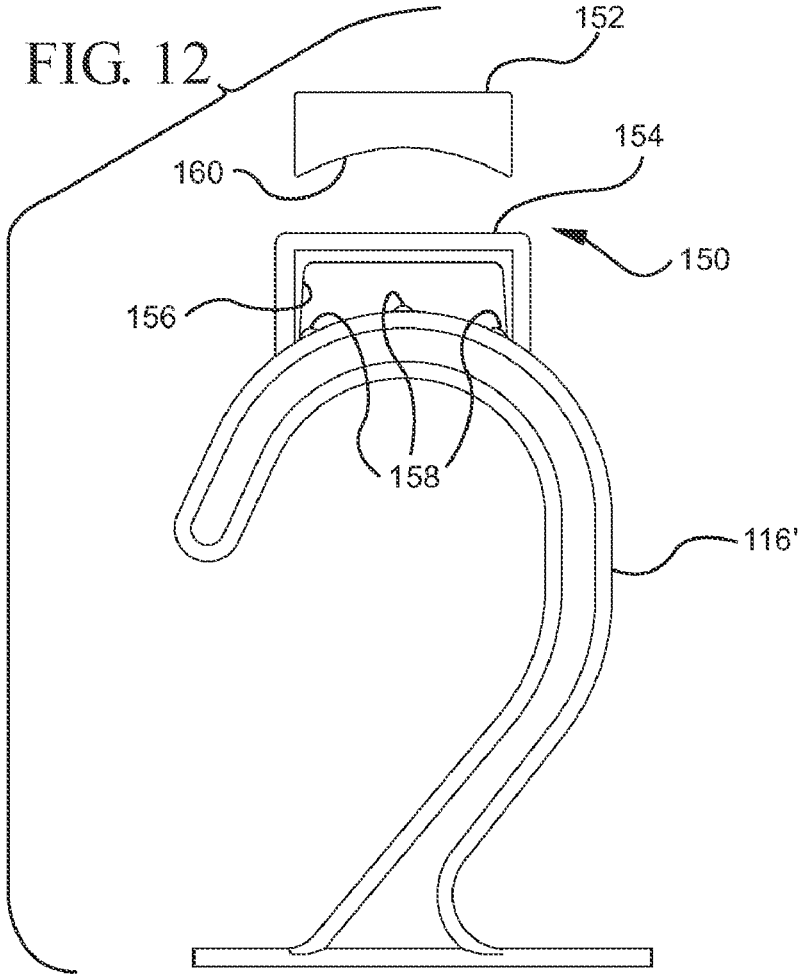
FIG. 12 is an exploded front elevational view of a fourth embodiment of a hanger and sizer formed in accordance with the present invention.

In still another preferred embodiment, as shown in FIG. 12, a sizer-receiving frame 150 can be secured to an upper portion of hook 116 and can be sized and shaped to receive an alternative sizer, e.g., top sizer 152. In this regard, frame 150 preferably includes a pair of opposing walls 154 defining a slot therebetween, as well as a supporting edge 156. Finally, the frame preferably includes plurality of opposing ribs 158 which define a slot for receiving and supporting the leading insertion edge 160 of sizer 152. Of course, it is contemplated herein that the sizer-receiving frame can be designed in various shapes, and can also be designed to allow the sizer to be inserted from a side edge thereof.

Thus, while there have been described what are presently believed to be the preferred embodiments of the present invention, those skilled in the art will appreciate other and further changes and modifications thereto, and it is intended to include such other changes as come with the scope of the invention.

The invention claimed is:

1. A garment hanger, comprising:

a body;

a hook having a base portion joined to said body and an outer surface forming an acute angle with said body, said acute angle defining a notch at the junction of said body and said base portion of said hook;

a sizer-receiving frame positioned within said notch, at least a portion of said frame extending between and connecting said hanger body and said base portion of said hook, said frame defining a sizer-receiving slot, said hanger body and said hook and said frame being generally coplanar, and wherein said sizer-receiving frame includes a sizer-supporting arm, a pair of opposing sizer-supporting tabs, and a sizer-supporting edge, and wherein said arm extends between and connects said hanger body and said base portion of said hook, said edge being located at the apex of said notch, and wherein said arm and said edge define a first plane, and wherein said tabs define a second plane, said first plane being coplanar to said second plane, said sizer-receiving slot being defined between said planes;

a substantially flat and planar sizer positioned within said slot of said frame, said sizer including a leading portion configured to engage said sizer-supporting edge, said sizer further including a trailing portion; and a pair of opposing locking corners for retaining said sizer within said slot, said locking corners located on said arm and extending between said planes, each of said corners being positioned to contact said trailing portion of said sizer when said sizer is positioned in said slot.

2. The garment hanger according to claim 1, wherein said sizer is formed of paper.

3. A garment hanger, comprising:

a body;

a hook having a base portion joined to said body and an outer surface forming an acute angle with said body, said acute angle defining a notch at the junction of said body and said base portion of said hook;

a sizer-receiving frame positioned within said notch, at least a portion of said frame extending between and connecting said hanger body and said base portion of said hook, said frame defining a sizer-receiving slot, said hanger body and said hook and said frame being generally coplanar, and wherein said sizer-receiving frame includes first and second sets of opposing walls, and wherein said opposing walls define said sizer-receiving slot therebetween, said first set of opposing walls extending between and connecting said hanger body and said base portion of said hook, said second set of opposing walls being located at the apex of said notch;

a substantially flat and planar sizer positioned within said slot of said frame, said sizer including a leading portion configured to slide within said second set of opposing walls, said sizer further including a trailing portion.

4. The garment hanger according to claim 3, wherein said first set of opposing walls includes at least one ramping surface to allow insertion of said trailing portion of said sizer therepast while resisting withdrawal of said sizer from said frame.

5. The garment hanger according to claim 4, wherein said sizer is formed of paper.

* * * * *